US006352358B1

(12) United States Patent
Lieberman et al.

(10) Patent No.: US 6,352,358 B1
(45) Date of Patent: Mar. 5, 2002

(54) UNIVERSALLY POSITIONABLE CLIMATE CONTROLLED LIGHT ENCLOSURE

(75) Inventors: Lawrence Lieberman, Hartsdale; Karl Davis, New York, both of NY (US); Torrey Bievenour, Indianapois, IN (US)

(73) Assignee: Tempest Lighting, Inc., Farmingdale, NY (US)

( * ) Notice: Subject to any disclaimer, the term of this patent is extended or adjusted under 35 U.S.C. 154(b) by 0 days.

(21) Appl. No.: 09/437,166

(22) Filed: Nov. 10, 1999

Related U.S. Application Data

(60) Provisional application No. 60/107,932, filed on Nov. 11, 1998.

(51) Int. Cl.[7] ..... F21V 29/00

(52) U.S. Cl. ..... 362/294; 362/218; 362/373

(58) Field of Search ..... 362/294, 373, 362/376, 547, 218

(56) References Cited

U.S. PATENT DOCUMENTS 5,497,573 A * 3/1996 Stadjuyhar et al. ..... 362/294
5,743,631 A * 4/1998 Bigham ..... 362/294
5,779,353 A * 7/1998 Kacheria ..... 362/293

OTHER PUBLICATIONS

Product Specification for MAC Dome enclosure manufactured by Martin Professional A/S, Mar. 1999.

Product Specification for ECODOME (tm) manufactured by High End Systems, Inc., Lightwave Research, Oct. 17, 1996.

Product Specification for The Shroud (tm) manufactured by The Light Source, no date given.

Product Specification for Cyber Rain Shield manufactured by City Theatrical Inc, no date given.

* cited by examiner

*Primary Examiner*—Stephen Husar
(74) *Attorney, Agent, or Firm*—Joshua S. Broitman; Ostrager, Chong & Flaherty LLP

(57) ABSTRACT

A climate controlled, universally positionable enclosure having a clear glass projection window which may be used both indoors and outdoors to contain commercially available lighting fixtures which are not normally intended for outdoor use. The enclosure comprises a central light fixture/electronic component housing compartment, and means for directing and controlling the flow of air and moisture through the enclosure to prevent moisture from entering the housing compartment. The enclosure further comprises an electronic, multi-function climate control unit comprising heating and cooling devices which maintain the temperature and condensation inside the housing compartment within the light fixture's preferred operating range. The outside surface of the enclosure comprises a plurality of mounting channels to which brackets or bolts may be attached for universal mounting.

19 Claims, 9 Drawing Sheets

UNIVERSALLY POSITIONABLE CLIMATE CONTROLLED LIGHT ENCLOSURE

This application claims benefit of Provisional No. 60/107,932 filed Nov. 11, 1998.

FIELD OF THE INVENTION

This invention generally relates to an apparatus for enclosing lighting fixtures to enable their use in any environment. More particularly, the invention relates to a climate controlled, universally positionable enclosure for protecting an intelligent lighting fixture from harmful environmental stresses.

BACKGROUND OF THE INVENTION

For purposes of this disclosure, the term "intelligent lighting fixture" shall refer to lighting fixtures of the type having an automated and movable light beam which can be varied in color. Typical intelligent lighting fixtures pan and tilt their light beams using either a movable mirror ("movable mirror-type fixture") or by moving the lamp source and lens set ("moving head/yoke-type fixture"). Intelligent lighting fixtures may also feature color changing, beam focus, zoom lenses, rotating beam patterns, beam shaping and quick shutting with movement. Intelligent lighting fixtures are regularly used in all aspects of indoor and controlled environment outdoor entertainment lighting, for example, television, theater, film, concerts, casino and theme retail restaurants and shops. Examples of intelligent lighting fixtures are the CYBERLIGHTS® fixture manufactured by High End Systems, Inc. (Austin, Tex.) and the STAGESCAN™ fixture manufactured by Clay-Paky (Pedrengo, Italy).

Other than the typical uses for intelligent lighting fixtures, it is often desirable to utilize lights having intelligent lighting fixture features in unprotected outdoor locations or in indoor locations having environmental conditions dangerous to the lighting fixtures, such as particulate or smoke, or in locations having noise restrictions. Examples of such uses include architectural lighting, theme parks, office building atriums and multi-function halls. However, commercially available intelligent lighting fixtures are not designed to withstand the undesirable environmental conditions or noise restrictions associated with these uses.

Several manufacturers have attempted to produce moving lights which overcome these problems, however these lights are only capable of changing the light beam's color or pattern. There have been no intelligent lighting fixtures intended for permanent outdoor use which also have the ability to move the light beam.

Other manufacturers have attempted to overcome the problems associated with adverse environmental conditions by providing "enclosures" for containing and protecting their own intelligent lighting fixtures. For example, an enclosure manufactured by High End Systems, Inc. under the name ECODOME™ was designed exclusively for their own product line. Such enclosures generally afford three categories of protection. A first category is a low end solution which provides only light rain protection using a rain jacket type sleeve or an open sheet metal rain shield box, for example the Cyber Rain Shield manufactured by City Theatrical Inc. This solution is temporary and is intended to provide protection only from light foul weather. A second category is another low end solution which provides cooling in addition to light rain protection. For example, the MAC DOME™ manufactured by Martin Professional A/S (Denmark) comprises a plastic trash can shaped enclosure having a clear transparent dome for the beam to shine out of and a fan for intake and exhaust. This enclosure must be hard wired into place and must be mounted in a position with the dome facing the sky, thereby limiting the enclosure's position. Another type of enclosure in this category comprises a sheet metal case similar to a coffin with a clear transparent shield and a cooling fan, and also has limited mounting positions. The final category is an advanced permanently installed enclosure, which provides both cooling and heating and is used in applications which require protection for sensitive electronic equipment, such as cellular transmission sites. None of the commercially available enclosures, however, may be used with any commercially available intelligent lighting fixture.

It is therefore a broad object of the invention to provide an enclosure for protecting any commercially available intelligent lighting fixture which overcomes the disadvantages associated with conventional light fixtures and enclosures.

A more specific object of the invention is to provide a light enclosure which enables an indoor-use only lighting fixture to be fully operational in outdoor environments or in indoor environments having noise restrictions or environmental conditions dangerous to the lighting fixtures.

A further object of the invention is to provide a universally positionable light enclosure having outdoor use features, including climate and moisture control, anti-tampering and anti-theft features, as well as sound baffling features, which may be used with a wide variety of conventional lighting fixtures.

SUMMARY OF THE INVENTION

In the present invention, these purposes, as well as others which will be apparent, are achieved generally by providing a water impermeable, semi-insulating enclosure having a climate-controlled light fixture housing compartment with a non-distorting clear projection window therein. The enclosure can be operated in ambient temperatures ranging from 0° F. to 115° F.

In a preferred embodiment of the invention, the enclosure comprises a fiberglass shell having three adjacent compartments, two outer compartments surrounding a light fixture housing compartment. The shell has top and bottom portions pivotally connected on one side to allow access to the inside of the enclosure. Dual gas springs are provided between the top and bottom portions to allow for easy opening of the top portion and a safety cable connects the top and bottom portions to prevent the top portion from opening too far. The top portion further has a glass projection window in the housing compartment section thereof. Each of the outer compartments include vent openings which may be fitted with air filters for directing and controlling the flow of air and moisture through the enclosure, and preventing moisture from entering the light fixture housing compartment.

The enclosure further comprises an electronic, multi-function climate control unit comprising heating and cooling devices controlled by a microprocessor and a temperature sensor to maintain the temperature and condensation inside the light fixture housing compartment within the light fixture's preferred operating range. Preferred heating devices are of the type having a finned stainless steel metal sheath and a voltage rating of 200–240 VAC. Preferred cooling devices include fans with a combination rating of at least 250 cubic feet per minute (CFM). Preferred microprocessors are capable of switching the fan speed between full on power and a reduced pulsing fan power, at which the fan has adjustable on and off times, to achieve an effective dual CFM rating using only one fan. The outer surface of the enclosure's lower or bottom portion comprises a plurality of mounting channels to which brackets or bolts may be attached for securing the enclosure in any orientation.

Other objects, features and advantages of the invention are described in detail below in conjunction with the drawings as follows:

DETAILED DESCRIPTION OF THE INVENTION

A water impermeable, semi-insulating light enclosure 10 in accordance with a preferred embodiment of the invention is shown in FIGS. 1–9B. Although the light enclosure has been designed to house many commercially available automated moving light fixtures, the light enclosure may also be used with other types of lighting fixtures.

The light enclosure of the present invention comprises a solid, hollow shell having three compartments—a light fixture housing compartment 12 and two outer venting compartments 14, 16. Each of the outer venting compartments have vent openings 15, 17 for directing and controlling the flow of air through the light fixture housing compartment 12. The enclosure may be made from any solid, water-impermeable and semi-insulating material, such as rigid and semi-rigid synthetic materials (i.e., plastic, fiberglass) or natural materials (i.e., aluminum, steel).

Figure 8:
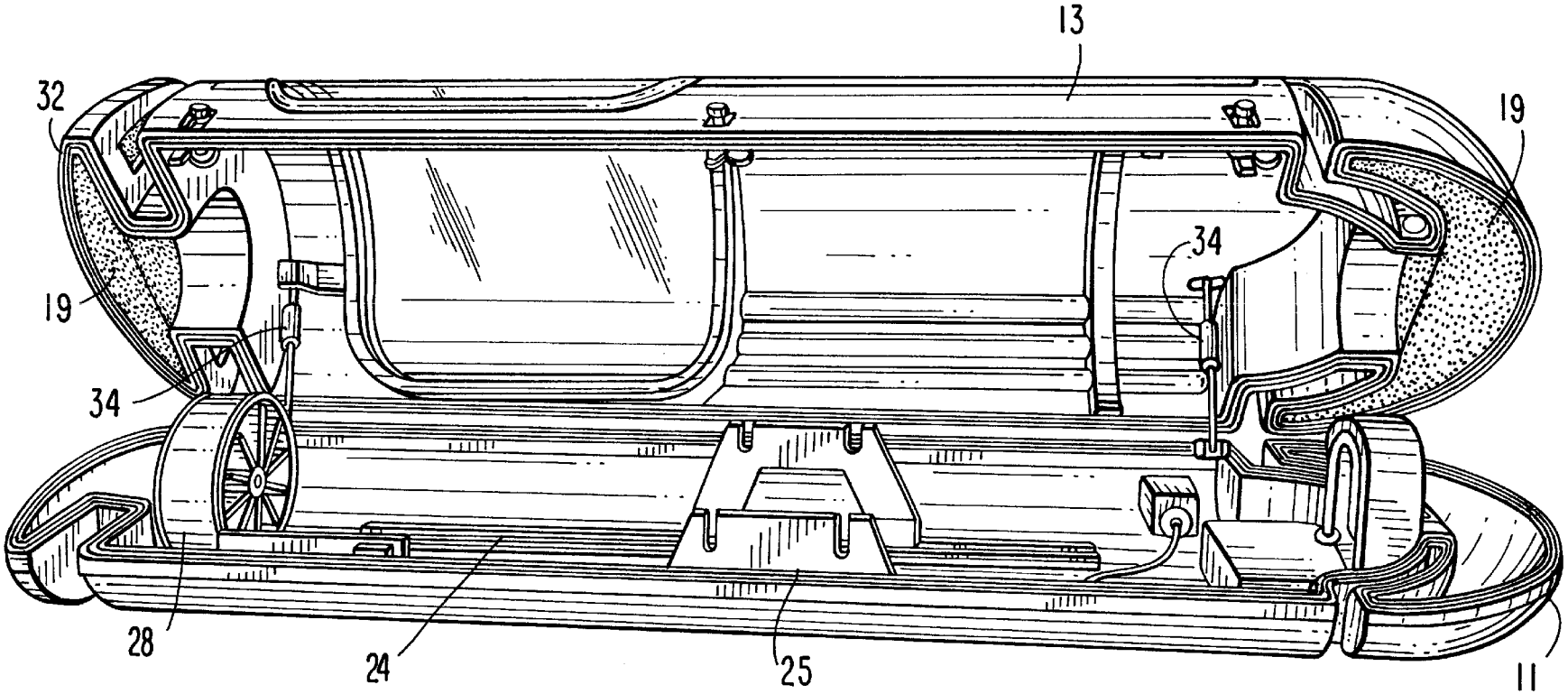
FIG. 8 is an illustration of the light fixture of FIG. 1 in an open position.

As best shown in FIG. 8, the shell of the enclosure 10 comprises a bottom 11 and top 13 portion connected via a series of hinges (not shown) on one side of the enclosure to permit all three compartments of the two portions to be pivotally opened for insertion of an automated moving light fixture. Two 75 pound gas springs 34 are fastened to the inner surfaces of the bottom and top portions 11, 13 to provide easy and controlled opening and closing of the enclosure in any position. The bottom and top portions each have water-sealing gaskets 32 running along their edges around the entire periphery thereof, which are compressed together to form a water-tight seal when the two portions 11, 13 are closed. Pull down or draw latches 23 located around the periphery of the enclosure are provided to compress the top and bottom portions together (see FIGS. 1 and 2). The latches are preferably made from stainless steel. At least one of the latches should also have a key locking fitting to provide security.

The top portion 13 of the housing compartment 12 comprises an aperture for insertion of an optically clear, scratch-resistant glass projection window 20. The projection window is affixed to the housing compartment with a water-sealing gasket and should be located proximate the location of the light fixture's light beam. Preferably, the projection window has a uniform curve to prevent distortion of the light image being projected through it. The horizon of the projection window therefore extends as low as the horizon contained on the moving light fixtures. Accordingly, the panning range of the light image is not limited by the enclosure. Similarly, the width of the projection window is selected such that the range of the light fixture's tilt is not limited, but is at least the same range of tilt as that permitted by the light fixture. The use of glass as the projection window maintains superior clarity and transmission of the light image emanating from the light fixture, and provides excellent durability against wear and surface degradation. The range and quality of a moving mirror light image is thus not limited when used within the enclosure.

Figure 1:
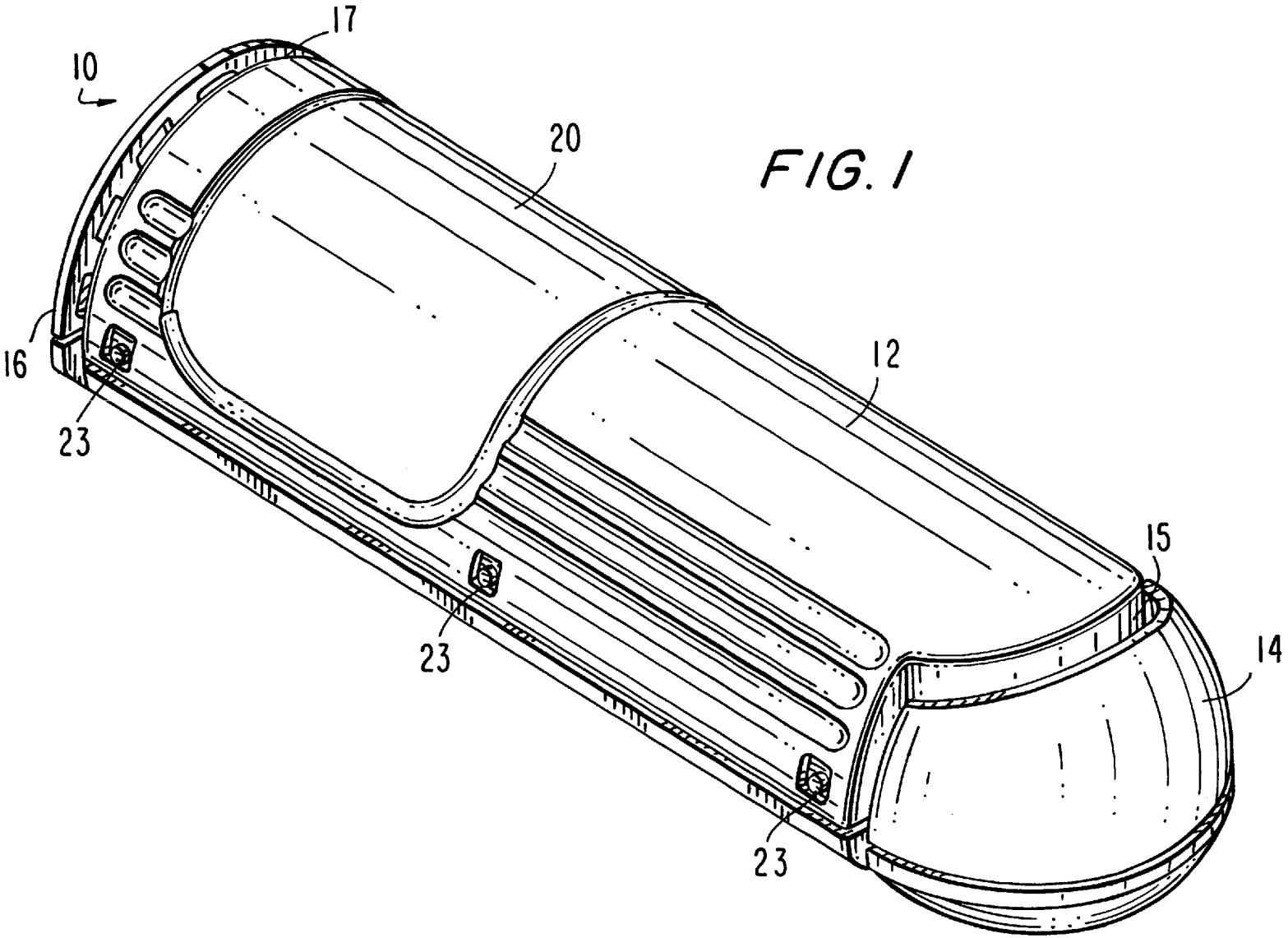
FIG. 1 is a top perspective view of a light enclosure in accordance with a preferred embodiment of the invention.
Figure 2:
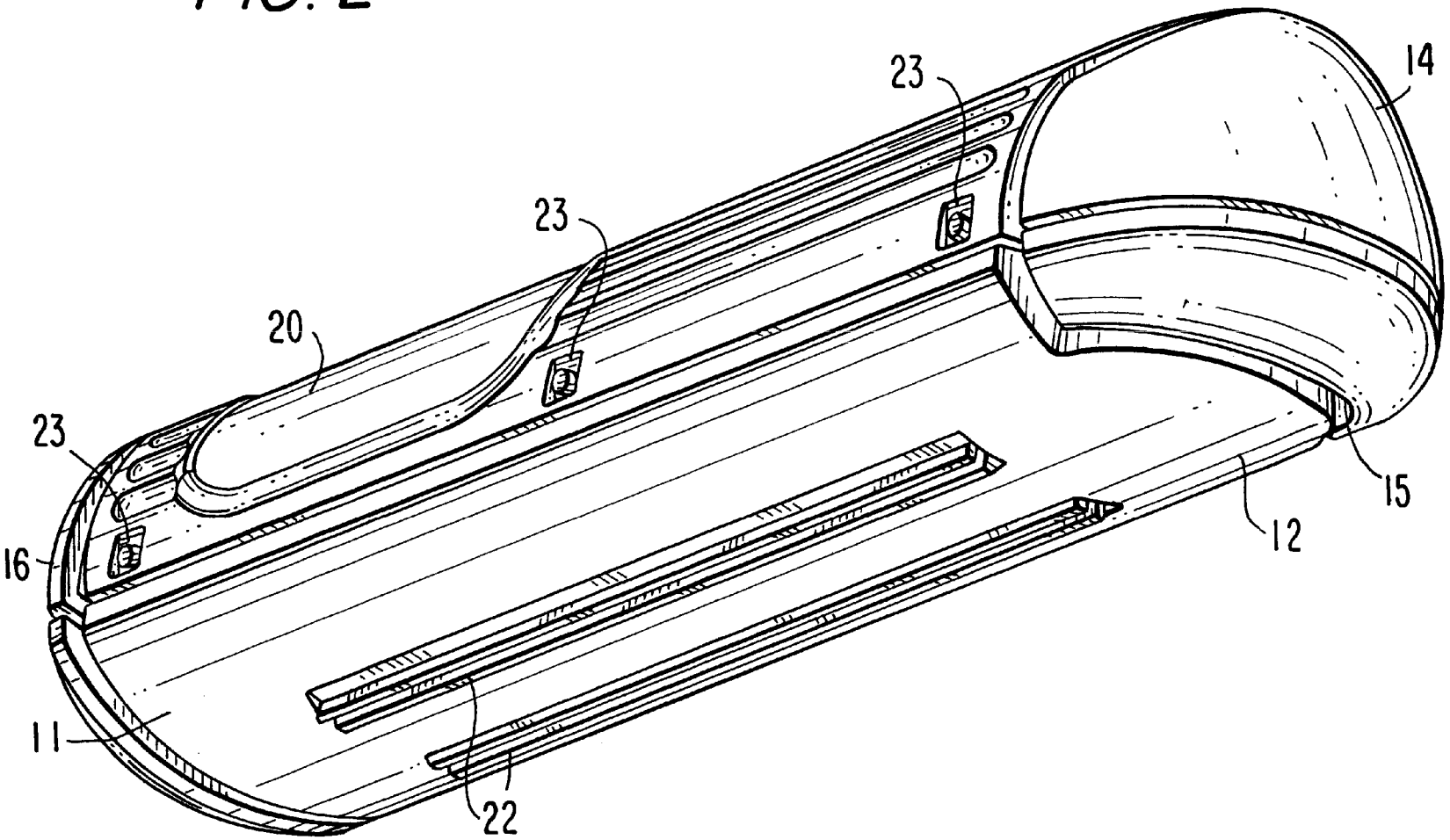
FIG. 2 is a bottom perspective view of the light enclosure shown in FIG. 1.
Figure 3:
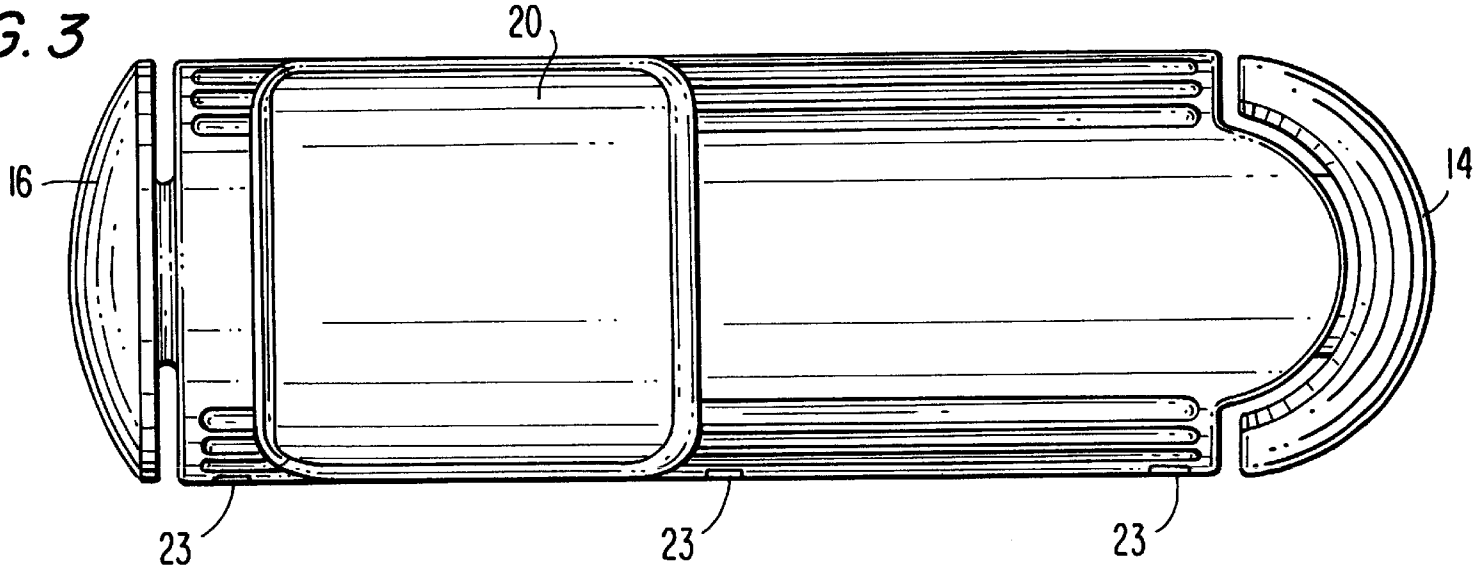
FIG. 3 is a top plan view of the light fixture of FIG. 1.
Figure 4:
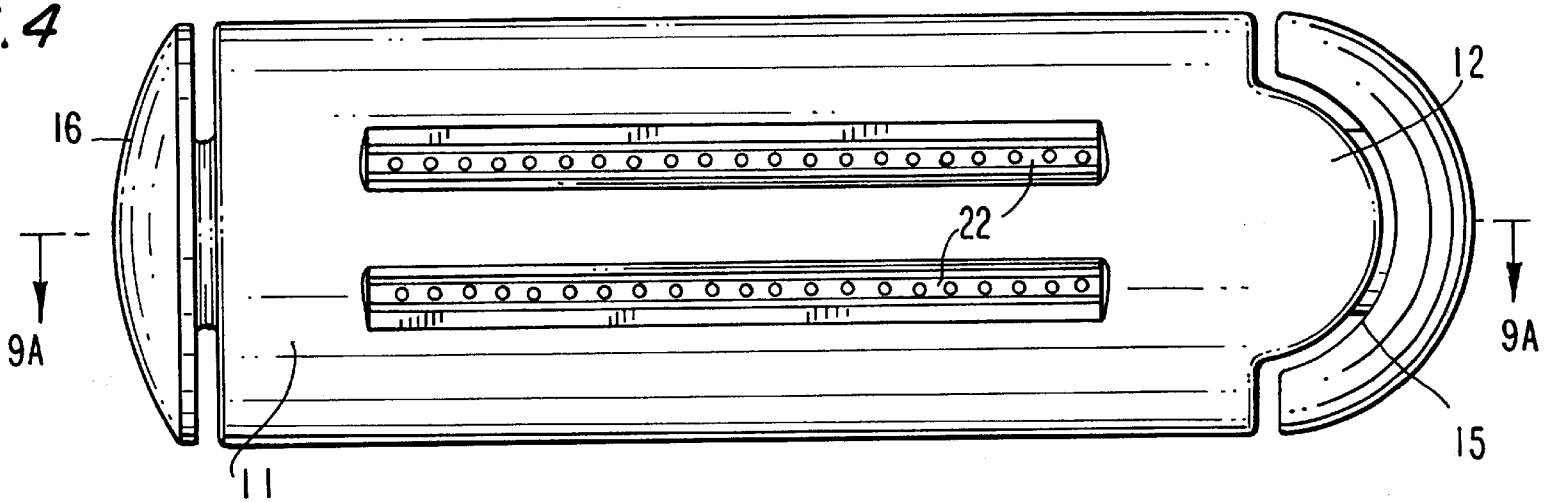
FIG. 4 is a bottom plan view of the light fixture of FIG. 1.
Figure 5:
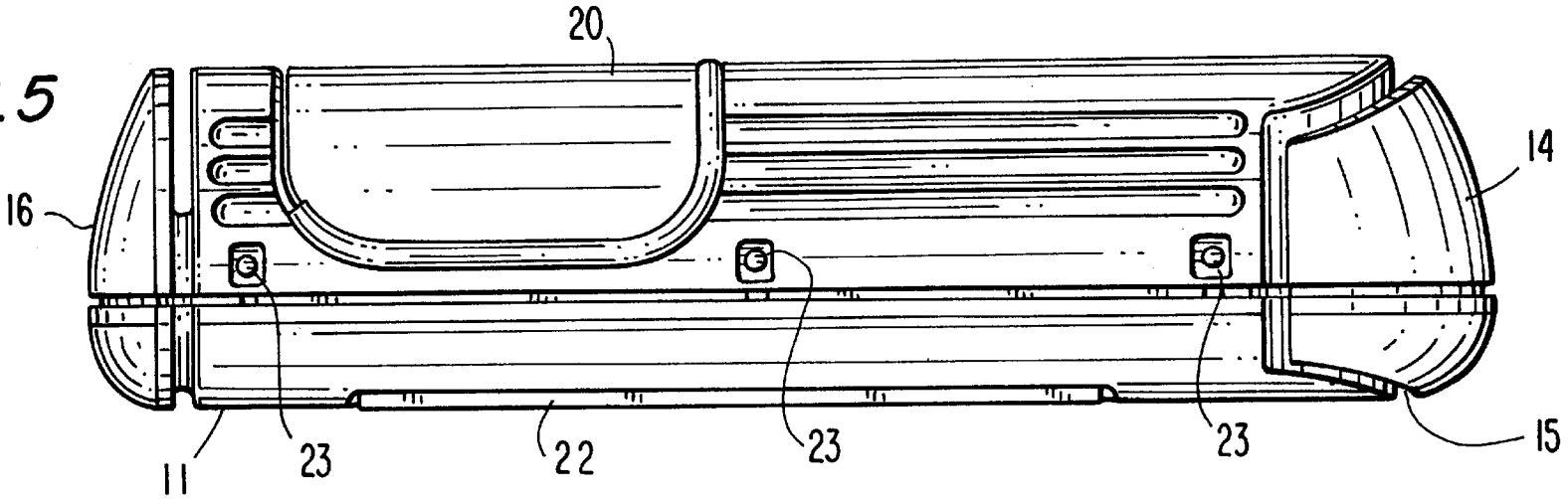
FIG. 5 is a left side plan view of the light fixture of FIG. 1.
Figure 7:
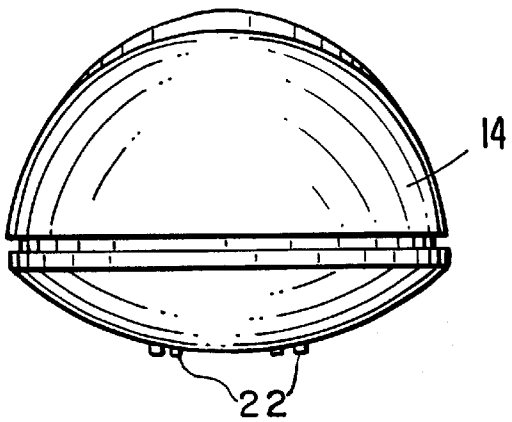
FIG. 7 is a bottom side plan view of the light fixture of FIG. 1.
Figure 6:
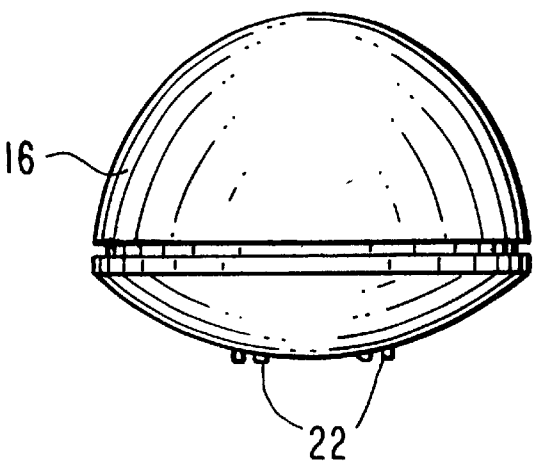
FIG. 6 is a top side plan view of the light fixture of FIG. 1.

The enclosure is universally mountable and may be secured to anything structural in any orientation, i.e., horizontally and vertically up or down, via commercially available yokes or brackets. As best shown in FIG. 2, the outer surface of the housing compartment's bottom portion 11 comprises a plurality of exterior mounting channels 22 to which a yoke(s), a bracket or bolt may be attached. In a preferred embodiment, flexibility of universal mounting, with respect to the attachment, is achieved by allowing a yoke or multiple yokes to bolt-on anywhere along a set of parallel Unistrut® metal (for example, stainless steel) channels 22, allowing the option of optimal center of gravity mounting which will vary depending on which light fixture 18 is being housed. The Unistrut® metal channels 22 on the outer surface are affixed by nut and bolt to a similar set of parallel Unistrut® metal channels 24 on the inner surface of the housing compartments bottom portion (see FIG. 9B). The inner metal channels 24 are configured to accept a yoke 25 or other attachment means of any one of a number of commercially available light fixtures. Therefore, this invention accommodates a large variety of lighting fixtures. The exterior Unistrut® channels 22 may also accommodate removable and adjustable exterior carrying handles (not shown) to permit easy movement and placement of the enclosure.

In any position, the enclosure's three compartment system simultaneously permits air to flow in one direction through the central housing compartment 12, but prevents rainwater or other moisture from directly or indirectly entering into the airway of the central housing compartment 12. This is achieved by having an outside-exposed intake 15 and an exhaust 17 vent opening located on the inner surfaces of the two side compartments 14, 16 perpendicular to the central compartment's airway plane, such that air flows past the vents'vertical plane before exiting through the vents. As shown in FIG. 9B, air flows into the enclosure through the vent 15 in side compartment 14, through an opening in a first sidewall of the central housing compartment 12, over and around the lighting fixture 18, through a second opening in a second side wall of the central housing compartment 12 and out of the enclosure through the vent 17 in side compartment 16. Washable, open cell air filters are provided in the empty spaces 19 of the side compartments 15, 16 at the inlet and outlet sides of the central housing compartment to prevent particulate and moisture from coming into contact with the lighting fixture, thereby improving performance and lowering maintenance costs. Causing the air to protrude into the side compartments and beyond the vertical plane containing the outside air vent openings 15, 17 creates an air "lip" that prevents rain water from running down the inner surfaces of the side compartments and indirectly entering the housing compartment through the airway. Weep holes are provided in the outer surfaces of the side compartments to drain any water that does enter through the vents. Therefore, the unique shape of the enclosure and the location of the air vents provides the ability to allow air to flow in one direction through the housing compartment without allowing water to enter, regardless of its orientation in space or the direction of precipitation in a wet location.

The enclosure further comprises an electronic, multi-function climate control system which may be programmed to maintain the temperature and moisture content (condensation) inside the light fixture housing compartment within the light fixture's preferred operating range (hereinafter referred to as the "Digital Enclosure Control System" or "DEC System"). This feature increases the longevity of the light fixture's components, as compared to use without the enclosure. The DEC system also controls the humidity and condensation build up in the enclosure by maintaining the temperature inside the enclosure higher than the outside temperature in conjunction with exchanging air inside the enclosure with warmer fresh air (in effect lowering the dew point). Further, the DEC system heats the enclosure and lighting fixture for optimal starting temperatures during cold ambient temperature conditions. The system's microprocessor provides controlled heating and cooling rates to reduce the rate of temperature change within the lighting fixture and to prevent extreme temperatures. This feature reduces maintenance by reducing "screw creep" or screw loosening caused by differing material expansion rates.

As best seen in FIG. 9B, the DEC system comprises a heater 26, a fan 28, a temperature sensor (not shown) and a microprocessor 30. The microprocessor 30 has three built in relays for controlling the heater, the fan and the power to the light fixture. The third relay cuts power to the light fixture if the air temperature inside the central compartment 12 gets above 164° F.

Figure 12:
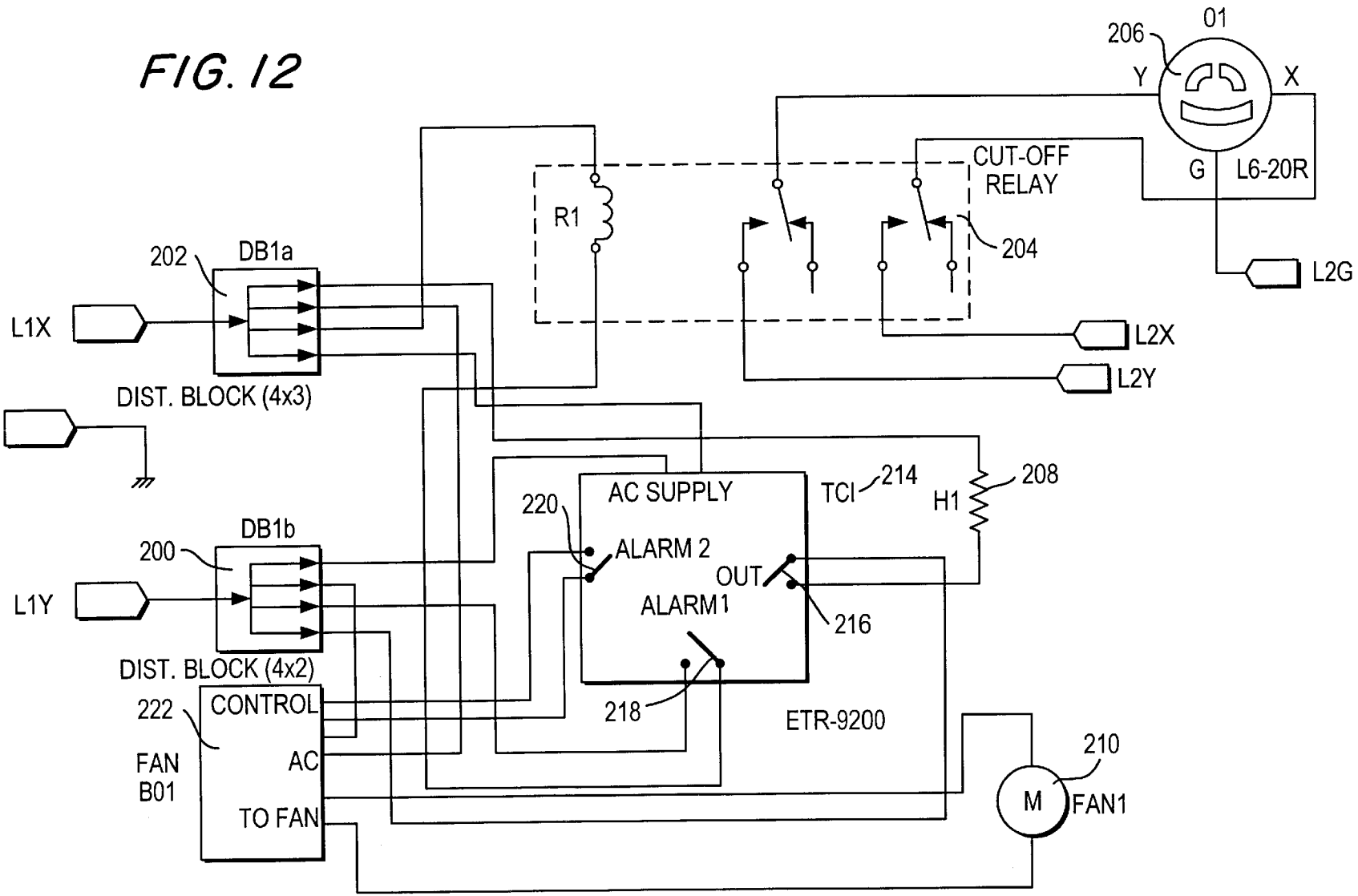
FIG. 12 is a circuit diagram showing a preferred circuit for controlling the light enclosure of FIG. 1.

Preferred heating devices are of the type having a finned stainless steel metal sheath and a voltage rating of 200–240 VAC. The heater 26 is placed in front of the intake opening 15 at one end of the enclosure. The heater is proportionally controlled, i.e., at 85° F., the heater will be on 1% of the time and at 32° F. will be on full time. The heater does not go on when the temperature is over 85° F. The air temperature is measured with a temperature sensor near the exit 17 of the enclosure, which provides a signal TC1 to microprocessor 30, as shown in FIG. 12. A suitable temperature sensor is a Teflon insulated thermocouple. Providing this low-level proportional heating function maintains the internal housing compartment temperature at least several degrees warmer than the outside ambient temperature, to virtually eliminate condensation on the lighting fixture. These temperature parameters of course can be varied depending on the size of the enclosure and type of light fixture being enclosed.

Figure 9A:
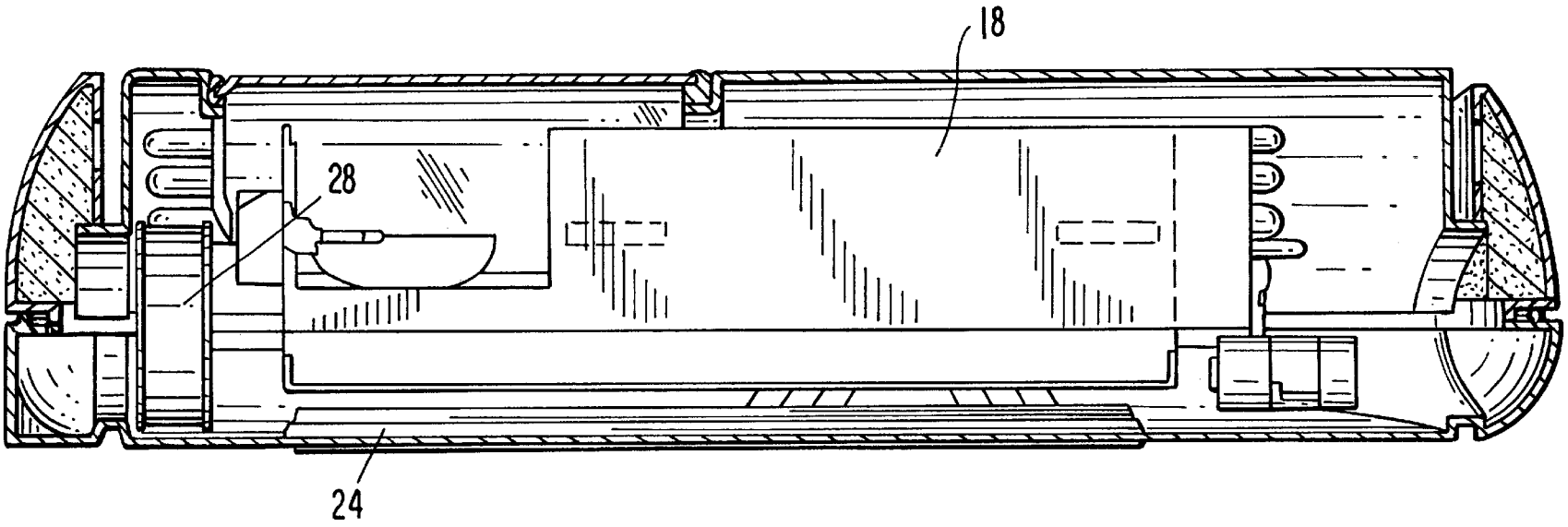
FIG. 9A is a cross-sectional view of the light fixture shown in FIG. 4, taken along the line 9A—9A.
Figure 9B:
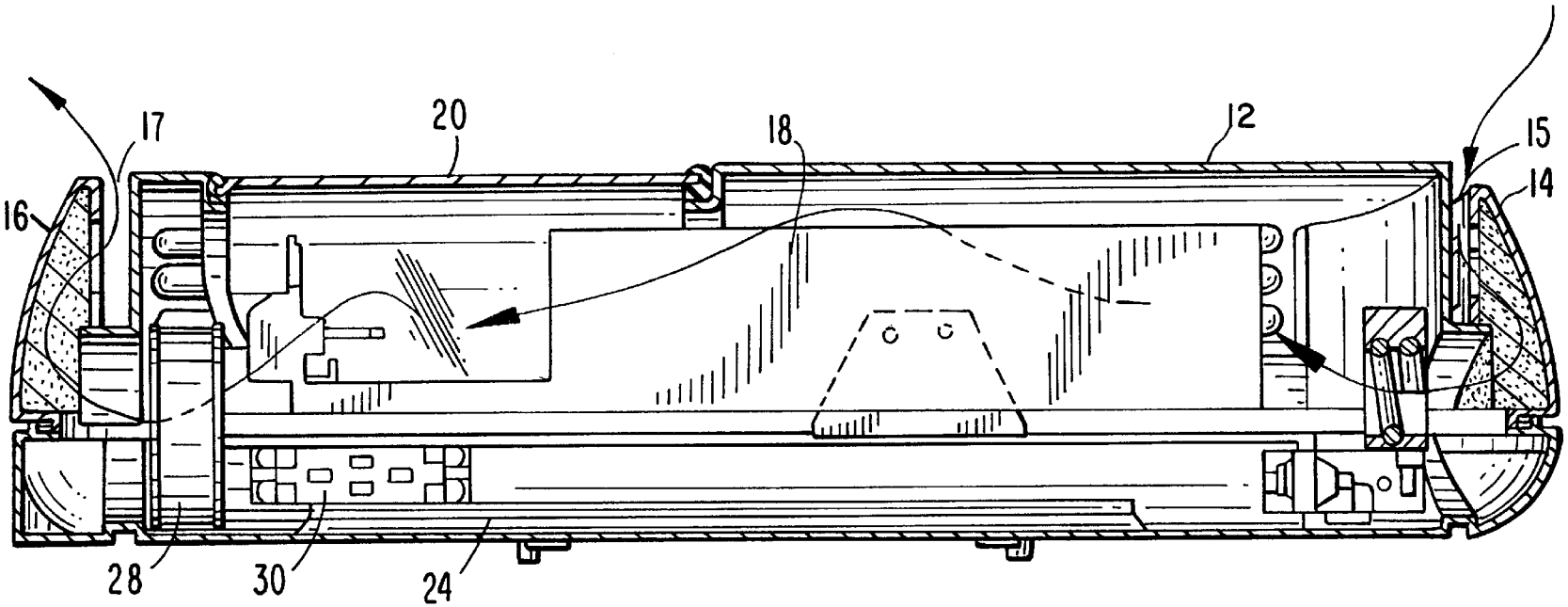
FIG. 9B is a cross-sectional illustration showing the flow of air through the light fixture shown in FIGS. 1–8.

As shown by the arrows in FIG. 9, the fan 28 draws fresh air into the housing compartment 12 past the heater 26 and through the light fixture 12. The internal fans on the fixture pull in the fresh air and exhaust the hot air. The enclosure fan 28 draws the fresh cool air in and exhausts hot air. Preferred cooling devices include low decibel (dB) fans with a rating of at least 250 cubic feet per minute (CFM), and preferably 550 CFM. Baffles are provided in the housing compartment to direct the air from the lighting fixture's air exhaust vents.

Preferred microprocessors are capable of switching the fan speed between full on power and a reduced pulsing fan power, at which the fan has adjustable on and off times, to achieve an effective dual CFM rating using only one fan. The microprocessor 30 turns the fan 28 on when the exhaust temperature reaches 92° F. and turns the fan off when the exhaust temperature is 82° F. A custom circuit is placed in line with the fan to serve a dual purpose. The circuit lowers the voltage from 220V to 12V and pulses the fan to continually exchange air within the enclosure. This is a very unique solution to providing a dual speed for a fan. Typically, fans can run at only one-half their rated CFM power level. The minimum power a 250 CFM fan can be run at is approximately 125 CFM and the minimum power a 550 CFM fan can be run at is approximately 225 CFM. Therefore, the power in fans having large CFM ratings cannot by itself be lowered to continually run the fan at reduced power levels below one-half CFM rating, for example, 30 CFM, which is one of the preferred fan power levels during operation of the enclosure. However, by pulsing the fan, we achieve exchange of air at 30 CFM to effectively exchange air inside the enclosure. The circuit is adjustable to increase or decrease the pulsing to give a large range. Different size enclosures will require different settings. All of the parameters are adjustable and can be changed to better suit a different environment or enclosure.

An example of an electronic circuit for controlling the light enclosure is shown in FIG. 12. Power is applied and distributed to the circuit at input distribution blocks 200, 202. The circuit can be set to run on several voltages including 100V, 120V, 200–230V or 277V by wiring a jumper on the circuit board or using a switching power supply. The circuit comprises a large cut-off relay 204 that controls the flow of power to the light fixture power receptacle 206, a heater 208, one or more fans 210, a microprocessor controller 212 and a fan board 222. The fan board 222 controls the power applied to the fan 210 in response to signals received from the microprocessor controller 212. The microprocessor controller 212 receives an input signal TC1 (214) from the temperature sensor (not shown) identifying the temperature in the enclosure. If the temperature rises above a first predetermined temperature, the microprocessor controller 212 closes relay 220 (identified as "Alarm 2") which closes the circuit loop on the fan board 222 to provide full power to the fan 210 for cooling the enclosure (i.e., at least 250 CFM, preferably 550 CFM). If the temperature falls below a second predetermined temperature, the microprocessor controller 212 opens relay 220 and closes heater relay 216, which provides power to the heater 208 allowing it to heat the enclosure. At the same time the fan board 222 pulses the fan 210 on and off to slowly move fresh or outside air past the heater 208, and through and out of the enclosure. Pulsing of the fan 210 assists in preventing moisture from collecting inside the enclosure. The microprocessor controller 212 also controls a safety relay 218 that controls the large relay 204. If the microprocessor controller senses a failure in the system such as a rise in temperature above a third predetermined level, the microprocessor closes the safety relay 218 thereby activating the cut-off relay 204 and stopping the flow of power to the light fixture power receptacle 206 to protect the fixture from heat damage. The microprocessor controller 212 can be any commercially available microprocessor capable of performing the above-described functions. The circuitry for the fan board 222 used in this example was designed specifically for this application, but may be any circuitry capable of performing the above-described functions.

The enclosure is further provided with two electrical supply lines—one for the DEC system and one for the lighting fixture—and internal and external DMX electronic lines. The enclosure's electrical wiring is customary to wiring provided with commercially available intelligent lighting fixtures. After installation, power should be provided to the DEC system at all times to ensure proper operation and temperature control of the enclosure. However, power need not by supplied to the fixture at all times.

Figure 10:
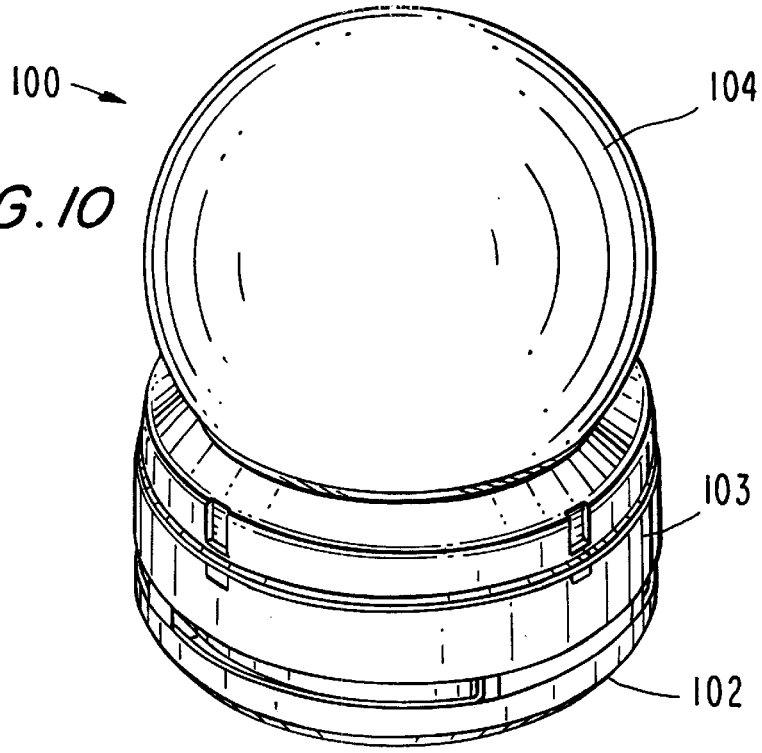
FIG. 10 is a perspective view of light enclosure in accordance with another preferred embodiment of the invention.
Figure 11:
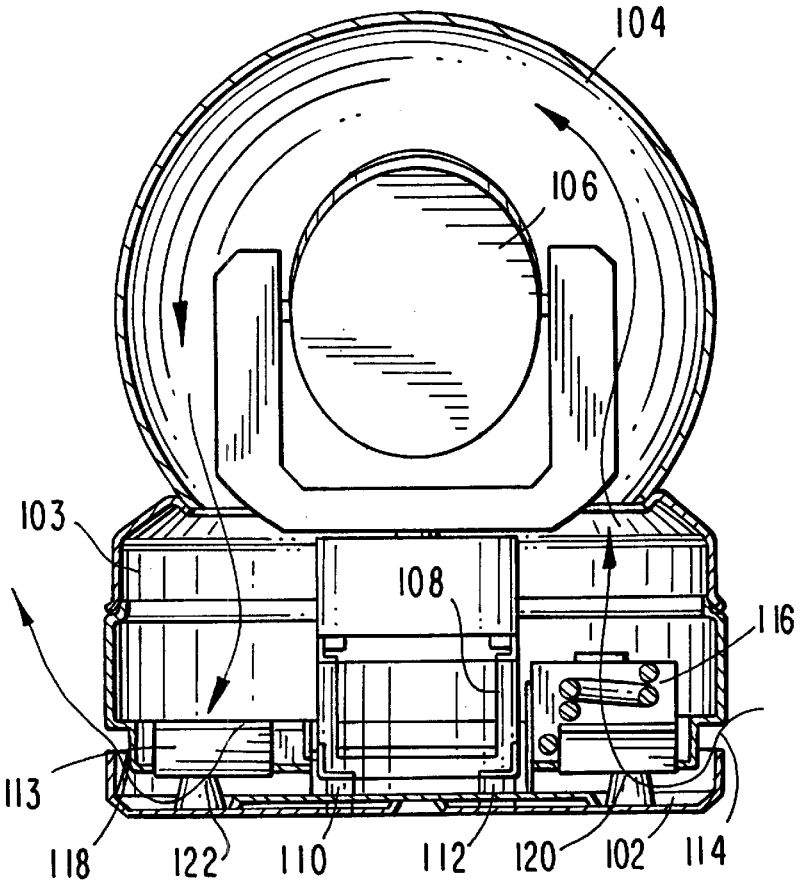
FIG. 11 is a cross-sectional illustration showing the flow of air through the light fixture shown in FIG. 10.

In FIGS. 10 and 11, a further embodiment of the invention is disclosed. In this embodiment, an enclosure 100 for moving head/yoke lighting fixtures comprises a base 102, a housing compartment 103 and a globe-shaped projection window 104. A fixture 106 is mounted in a yoke 108 inside the housing compartment 103 and dome 104. The yoke 108 is mounted to interior Unistrut® channels 110, which are mounted through the base 102 to a pair of exterior Unistrut® channels 112. As shown by the arrows in FIG. 11, a fan 113 forces air to flow into the base in a downward direction through an aperture 114. The air is heated by heater 116 and then forced through a baffle into and around the lighting fixture 106. The heated air then exits through a second aperture 118 in the base. The DEC system for this embodiment functions in the same way as described above for the first embodiment. Water is prevented from entering the enclosure by providing apertures 114, 118 for the passage of air in and out of the base 102 which are on the same horizontal plane as the inlet and outlet of air 120, 122 from the housing compartment 103.

It will be recognized by those skilled in the art that the product of the invention has wide application in the lighting industry and that numerous modifications are possible in light of the above disclosure. For example, the size and configuration of the enclosure can be modified depending on the types of light fixtures to be used, any heating, cooling and air forcing devices may be used. Therefore, it is to be understood that although preferred embodiments of the invention have been described, numerous modifications and variations are of course possible within the principles of the invention. All such embodiments, modifications and variations are considered to be within the spirit and scope of the invention as defined in the claims appended hereto.

We claim:

1. An apparatus for enclosing a light fixture comprising a water-impermeable shell having a light fixture housing compartment having inner apertures arranged for allowing air outside the housing compartment to flow into and through the housing compartment, and a climate control system for heating and cooling the air flowing into and through the housing compartment such that the temperature and moisture content inside the housing compartment is maintained within a preferred operating range for the lighting fixture regardless of the temperature and moisture content of the air outside the housing compartment.

2. An apparatus according to claim 1, wherein the climate control system maintains the air inside the housing compartment at a temperature higher than the temperature of the air outside the housing compartment, such that condensation inside the housing compartment is eliminated.

3. An apparatus according to claim 1, wherein the climate control system comprises a fan having a CFM rating of at least 250 CFM, a heater and an electronic circuit for controlling the fan and the heater such that the fan may be operated at a reduced power level substantially below the CFM rating to achieve a dual CFM rating using one fan.

4. An apparatus according to claim 3, wherein the climate control system maintains the air inside the housing compartment at a temperature higher than the temperature of the air outside the housing compartment, such that condensation inside the housing compartment is eliminated.

5. An apparatus according to claim 3, wherein the electronic circuit pulses the fan on and off for adjustable time periods to achieve the reduced power level.

6. An apparatus according to claim 1, wherein the shell comprises a top portion and a bottom portion, the top portion having a window therein.

7. An apparatus according to claim 1, wherein the shell has an intake outer venting compartment and an exhaust outer venting compartment, each of the venting compartments being connected to the housing compartment via one of the inner apertures and having outer apertures, the inner and outer apertures being arranged such that air flows through the housing compartment in a plane perpendicular to the plane of the inner apertures and in and out of the venting compartments in a plane substantially parallel to the inner apertures.

8. An apparatus for protecting an intelligent lighting fixture from harmful environmental stresses, which comprises:

a lightweight, water-impermeable shell having a light fixture housing compartment, the housing compartment having an intake vent and an exhaust vent arranged for allowing air outside the housing compartment to flow into and through the housing compartment;

a heater arranged proximate the intake vent for heating the air as it enters the housing compartment;

a fan arranged proximate the exhaust vent for causing the air to flow through the housing compartment and out of the exhaust vent; and an electronic circuit for pulsing the fan on and off for adjustable time periods to achieve a dual CFM rating.

9. An apparatus according to claim 8, wherein the intake vent and the exhaust vent each have inner and outer apertures arranged for allowing air to flow through the housing compartment in a plane perpendicular to the plane of the inner apertures and in and out of the intake vent and the exhaust vent in a plane parallel to the plane of the inner apertures.

10. A method for protecting an intelligent lighting fixture from harmful environmental stresses, which comprises:

enclosing the lighting fixture in a lightweight, water-impermeable shell having a light fixture housing compartment and an intake vent and an exhaust vent surrounding the housing compartment to permit air to flow therethrough;

drawing air via a fan from outside the shell into the intake vent, through the housing compartment and out of the exhaust vent; and controlling the fan and a heater to maintain the temperature and moisture content inside the housing compartment within a preferred operating range for the lighting fixture regardless of the temperature and moisture content of the air outside the shell.

11. The method according to claim 10, wherein the air flowing through the housing compartment is maintained at a temperature higher than the temperature of the air outside the housing compartment.

12. The method according to claim 10, wherein the fan has a CFM rating of at least 250 CFM and is controlled by an electronic circuit to operate at a reduced power level substantially below the CFM rating to achieve a dual CFM rating using one fan.

13. The method according to claim 10, wherein the fan has a CFM rating of at least 250 CFM and is controlled to pulse on and off for adjustable time periods to achieve a reduced power level substantially below the CFM rating.

14. The method according to claim 12, further comprising the step of monitoring the temperature of the air flowing through the housing compartment and controlling operation of the fan and the heater in response to the temperature of the air flowing through the housing compartment.

15. The method according to claim 14, wherein the fan is operated at the reduced power level when the temperature of the air flowing through the housing compartment is below a preferred operating temperature of the lighting fixture, such that air from outside the shell is continually pulled into the housing compartment to control evaporation of condensation.

16. The method according to claim 14, wherein the fan is operated at its CFM rating when the temperature of the air flowing through the housing compartment is above a preferred operating temperature of the lighting fixture, such that the air from outside the shell cools the lighting fixture.

17. An apparatus according to claim 8, wherein the electronic circuit, the fan and the heater maintain the air inside the housing compartment at a temperature higher than the temperature of the air outside the housing compartment, such that condensation inside the housing compartment is eliminated.

18. An apparatus according to claim 8, wherein the fan has a CFM rating of at least 250 CFM, and the electronic circuit controls the fan such that the fan may be operated at a reduced power level substantially below the CFM rating to achieve a dual CFM rating using one fan.

19. An apparatus according to claim 18, wherein the electronic circuit pulses the fan on and off for adjustable time periods to achieve the reduced power level.

* * * * *